United States Patent [19]

Foolen

[11] 4,262,380

[45] Apr. 21, 1981

[54] BUOY INCLUDING A MOORING DEVICE

[75] Inventor: Johannes A. Foolen, Eze sur Mer, France

[73] Assignee: Single Buoy Moorings, Inc., Fribourg, Switzerland

[21] Appl. No.: 46,421

[22] Filed: Jun. 7, 1979

[30] Foreign Application Priority Data

Jun. 9, 1978 [NL] Netherlands ..... 7806287

[51] Int. Cl.[3] ..... B63B 21/52

[52] U.S. Cl. ..... 9/8 P; 114/230; 141/388

[58] Field of Search ..... 9/8 R, 8 P; 114/230; 137/236 OS; 141/387, 388; 175/7; 405/203, 205

[56] References Cited

U.S. PATENT DOCUMENTS

| | | | |
|---|---|---|---|
| 3,017,934 | 1/1962 | Rhodes et al. | 9/8 R X |
| 3,324,943 | 6/1967 | Price | 175/7 X |
| 3,355,899 | 12/1967 | Koonce et al. | 175/7 X |
| 3,408,669 | 11/1968 | Mott | 9/8 R |
| 4,019,213 | 4/1977 | Behar et al. | 9/8 P |

*Primary Examiner*—Sherman D. Basinger
*Attorney, Agent, or Firm*—Young & Thompson

[57] ABSTRACT

A mooring device comprising a vessel and a buoy interconnected by an outrigger having a horizontal pivot axis connection with the vessel and a universal joint with the buoy. The buoy has a vertical traction-resistant torsionally stiff connection with a ground anchor, an auxiliary buoy being provided with a similar connection to a ground anchor and a parallel guide connection with the first-mentioned buoy. The auxiliary buoy carries a tubular connection between a conduit at the bottom and the top of the buoy in such a way that disconnection is easy.

5 Claims, 2 Drawing Figures

Figure 1:
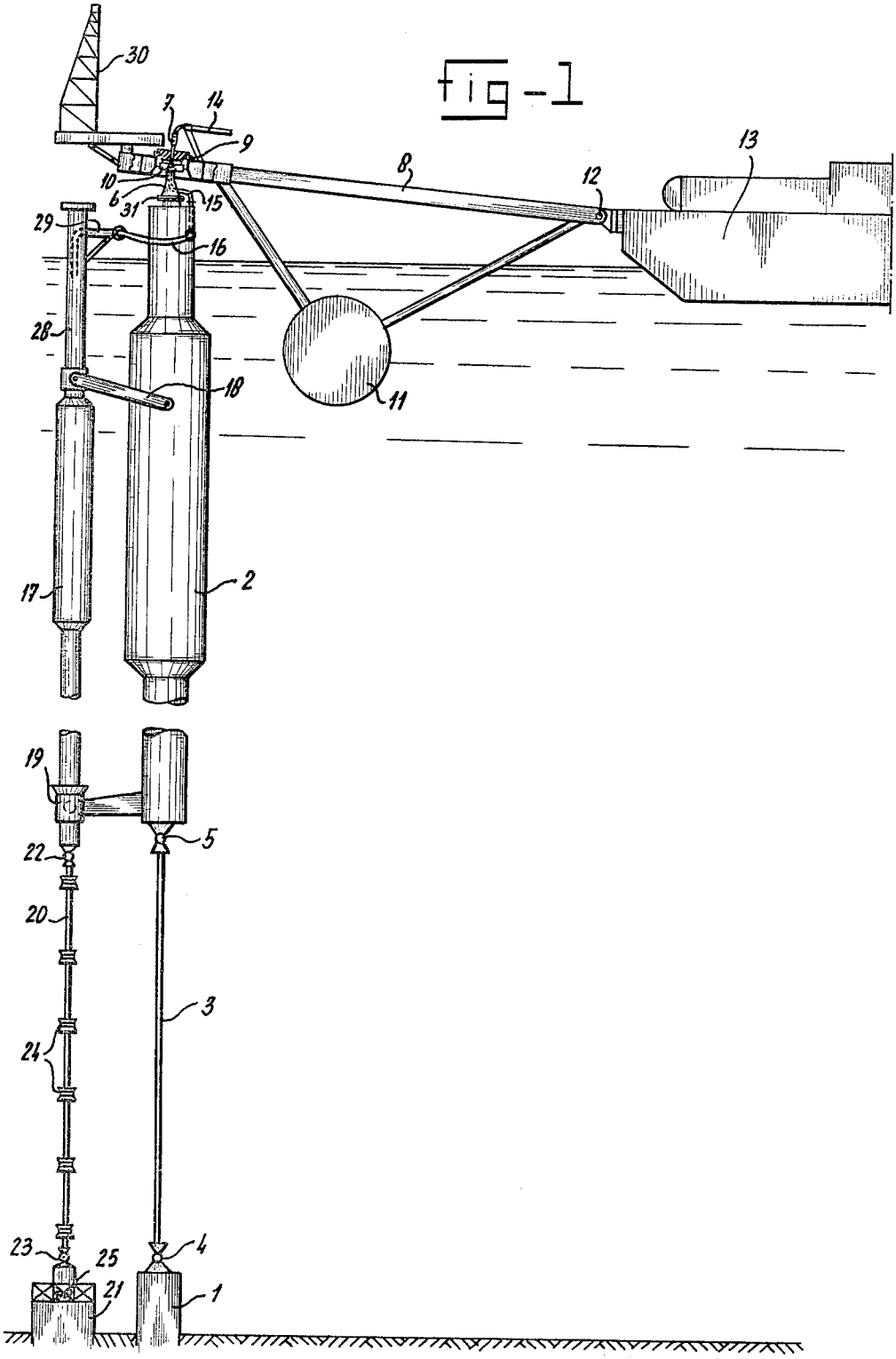

30
7
14
9
10
6
31
15
8
12
13
29
16
28
18
11
17
2
19
5
22
20
3
24
23
25
4
21
1

BUOY INCLUDING A MOORING DEVICE

The invention relates to a buoy in particular for a mooring device, comprising a ground anchor, an essentially submerged buoy body and a traction-resistant substantially torsionally stiff connection between the ground anchor and the buoy body. The mooring device comprises a floating device that by means of an outrigger hingedly affixed thereto around a horizontal axis has been coupled with the traction-resistant torsionally stiff connection through a universal joint.

A similar buoy and a buoy including a mooring device have been disclosed in the Dutch patent application No. 75.02829 laid open to public inspection. In this known device a pipe connection runs along the traction-resistant torsionally stiff connection from the bottom of the sea up to a rotatable pipe coupling, for instance mounted on top of the buoy, from which there again runs a connection to the floating device, for instance via the outrigger. This pipe connection includes several flexible parts.

Experience with this known device has now disclosed that under very bad weather conditions violent movements may occur in these flexible parts on the pipe of pipes whereas to the well body or on the pipes fastened to the sea bottom there may also be applied very massive forces capable of causing serious damage.

Such circumstances occur in particular when the weather conditions are so bad that the floating device has to be uncoupled in order to survive the storm elsewhere.

The object of the invention is to provide a buoy including a mooring device by means of which it is possible to restrict or to eliminate the wear of the flexible piping parts and to keep the well body free from forces acting thereon caused by movements of the buoy body under the influence of the weather conditions even if the floating device has been uncoupled.

According to the invention this object is attained by providing an auxiliary buoy next to the traction-resistant torsionally stiff connection, said auxiliary buoy being coupled with said connection through a parallel guide and having itself a traction-resistant torsionally stiff connection to a body fixed to the bottom, e.g. a well body, said auxiliary buoy furthermore carrying the pipes having disconnectable flexible tube connections at the upper end and lower ends thereof. Accordingly this means that the pipes have been provided in a separate buoy, whereas the mooring forces will be taken up by the usually present buoy. The pipes may be uncoupled at the upper and lower ends thereof and are accessible and manageable from above and may optionally be stored in the auxiliary buoy. Upon the threat of bad weather the pipe connections may be uncoupled, whereupon the floating device may be disengaged so that the buoy and the auxiliary buoy remain in place. These may then move freely without the application of stresses to the flexible parts of the pipes and without the application of forces on the well body. It is preferred that the auxiliary buoy possess a storage space for storing the pipes and for the traction-resistant torsionally stiff connection of the auxiliary buoy that has been provided with pipe guides provided at some distance with respect to each other. During bad weather the pipe sections and the connection parts of the auxiliary buoy may hence be stored in the auxiliary buoy. Upon reestablishment of the torsionally stiff connection between the auxiliary buoy and the well body the pipe sections may again be lowered through the pipe guides whereupon they may again be connected to the pipes provided at the sea bottom.

Figure 2:
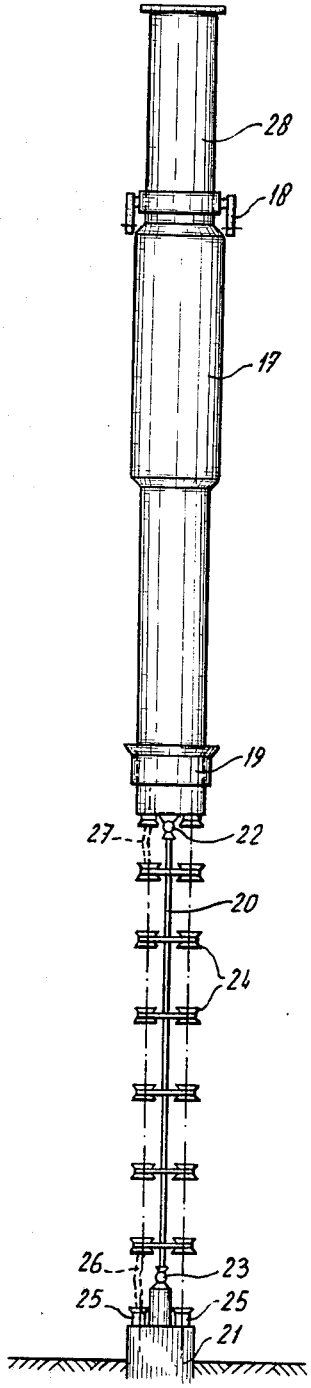

The invention will now be described in further detail with respect to the drawings in which FIG. 1 shows a schematical side elevation of the device according to the invention, and FIG. 2 shows an elevation of the auxiliary buoy. The latter side elevation has been rotated 90° with respect to the side elevation of the auxiliary buoy in FIG. 1.

With reference to FIG. 1 there has been shown a ground anchor 1 and a buoy 2 connected to the anchor 1 by means of a traction-resistant torsionally stiff connection 3. This traction-resistant torsionally stiff connection may consist of a chian or of a rod or pipe. When using a rod or pipe the upper end and optionally the lower end thereof have been provided with universal joints 4 and 5, respectively. The buoy 2 has a submerged portion of relatively large cross-sectional area and a portion of relatively small cross-sectional area intersecting the water surface.

Above the water level the buoy body 2 carries a head 6 which head has been mounted in a detachable manner to the top part of the buoy 2 and has been provided with a rotatable pipe coupling 7. Connected to said head through a axial-radial bearing 9 and an universal joint 10 is an outrigger 8.

The outrigger has a float 11 and possesses as such a horizontal joint connection 12 with the buoyant body 13 which may for instance be a tanker. Running from the rotatable coupling 7 is a tube 14 extending to a not shown medium conduit present on the outrigger 8. Underneath the rotatable coupling 7 is a pipe conduit 15 onto which a tube 16 may be coupled.

Next to the buoy 2 there is an auxiliary buoy 17 that is kept substantially parallel to the buoy 2 by means of rigid hinged arms 18 and a slidable turning joint 19. The upper arm 18 is pivvoted at each end with a respective buoy while lower arm 18 is rigid with buoy 2 and has the slidable and pivotal connection 19 with auxiliary buoy 17. Arms 18 permit vertical movement between the buoys 2 and 17. This auxiliary buoy 17 has a traction-resistant torsionally stiff connection 20 with a body 21 present on the sea bottom, e.g. a well body, which connection has also universal joints 22, 23.

This connection 20 having a disengageable character includes several guides 24 through which pipe sections may be lowered and coupled to connecting pipe sections 25 on the well body 21. Each pipe section lowered that far has at the lower end thereof a torsionally stiff tube section 26 creating the possibility to achieve a screwed pipe coupling. At the site of the upper universal coupling 22 there are likewise required torsionally stiff tube sections 27.

The upper part of the auxiliary buoy, as has been indicated with the reference numeral 28 has been provided with a pipe section 29 that may be coupled to a tube 16.

On the end of the outrigger 8 is a hoisting device 30 by means of which pipe sections may be handled in a way known per se and thus may be lowered via the hollow interior part of the auxiliary buoy 17 and through the guides 24 for achieving a connection with the pipe ends 25.

In case it is required to uncouple the connections at 25, the tube sections 26 are disengaged, followed by raising the pipe sections and storing the same in the interior space of the auxiliary buoy. Subsequently the connection 20 may also be disengaged and stored in the auxiliary buoy.

Furthermore the tube 15 is uncoupled and the head 6 is released at the flanges 31. The buoyant body 13 may then sail away.

Within the scope of the invention it is conceivable to make the construction of the device such that in the traction-resistant torsionally stiff connection between the anchor 1 and the outrigger 8 the buoy 2 is absent and its function is taken over by the float 11. In the coupled condition the float 11 then provides the mooring forces, whereas in the uncoupled condition the auxiliary buoy 17 will keep the entire construction upright.

I claim:

1. In a mooring device comprising a submerged buoy having a submerged portion of relatively large cross-sectional area and intersecting the surface of the water with a portion of relatively small cross-sectional area, a traction-resistant torsionally stiff connection between the buoy and a ground anchor, said connection having joints between the buoy and the anchor, an outrigger by which the buoy is connected above the water level to a buoyant body, means pivotally interconnecting the outrigger and the buoyant body for swinging movement about only a horizontal axis, the outrigger being connected to said portion of relatively small cross section of the buoy by a universal joint above the water level, and a conduit extending from the bottom toward the top of the buoy and by means of a swivel at said universal joint via the outrigger toward the buoyant body; the improvement comprising an auxiliary buoy, guiding arm interconnecting the auxiliary buoy with the first-mentioned buoy, a traction-resistant torsionally stiff connection between said auxiliary buoy and a ground anchor, joints between said last-mentioned connection and said auxiliary buoy and last-mentioned ground anchor, said conduit comprising pipe sections extending parallel to the last-mentioned torsionally stiff connection and having disconnectible flexible tube connections at the upper and lower ends of the last-mentioned connection, said conduit also comprising parts extending through said auxiliary buoy and a tube connection from the top of the auxiliary buoy to the top of the first-mentioned buoy.

2. A mooring device as claimed in claim 1, said arms permitting relative vertical movement between said first-mentioned buoy and said auxiliary buoy.

3. A mooring device as claimed in claim 2, said arms being rigid.

4. A mooring device as claimed in claim 3, one of said arms being pivotally connected at its ends with both of said buoys.

5. A mooring device as claimed in claim 3, in which one of said arms is rigid with one of said buoys and has a slidable and pivotal connection with the other of said buoys.

* * * * *